US006343673B1

(12) United States Patent
Chang

(10) Patent No.: US 6,343,673 B1
(45) Date of Patent: Feb. 5, 2002

(54) TURBINE EXHAUST STRUCTURE FOR VEHICLE

(75) Inventor: Ming-Tien Chang, Fen-Yuan Hsiang (TW)

(73) Assignee: Liang Fei Industry Co., Ltd., Fen-Yuan Hsiang (TW)

( * ) Notice: Subject to any disclaimer, the term of this patent is extended or adjusted under 35 U.S.C. 154(b) by 0 days.

(21) Appl. No.: 09/657,174

(22) Filed: Sep. 7, 2000

(51) Int. Cl.[7] ..... G10K 11/00

(52) U.S. Cl. ..... 181/227; 181/228; 181/256; 181/277; 181/279

(58) Field of Search ..... 181/227, 228, 181/255, 252, 256, 269, 272, 277, 279, 280, 282

(56) References Cited

U.S. PATENT DOCUMENTS 3,121,469 A * 2/1964 Schelf ..... 181/277
4,327,815 A * 5/1982 Hattori ..... 181/277
5,884,666 A * 3/1999 Johnson ..... 181/277

* cited by examiner

*Primary Examiner*—Khanh Dang
(74) *Attorney, Agent, or Firm*—Rosenberg, Klein & Lee

(57) ABSTRACT

A turbine exhaust structure is provided for a vehicle which includes an exhaust tail pipe having an inner wall defining a screw hole. The turbine exhaust structure includes a turbine exhaust device secured in the inner wall of the exhaust tail pipe, and a bolt co-operating with a nut for securing the turbine exhaust device in the inner wall of the exhaust tail pipe through the screw hole. The turbine exhaust device includes a housing secured in the inner wall of the exhaust tail pipe, a wheel disk secured in the housing, a plurality of catch pieces mounted in the wheel disk, an axle base secured in a central portion of the wheel disk, an axle rod rotatably mounted in the axle base of the wheel disk and having a first end provided with a first vane wheel and a second end provided with a second vane wheel, and two bearings mounted between the axle base and the axle rod.

2 Claims, 7 Drawing Sheets

TURBINE EXHAUST STRUCTURE FOR VEHICLE

BACKGROUND OF THE INVENTION

1. Field of the Invention

The present invention relates to a turbine exhaust structure for an exhaust tail pipe or a muffler of a vehicle such as a car, a motorcycle or the like.

2. Description of the Related Art

A conventional exhaust tail pipe 10 for a vehicle such as a car, a motorcycle or the like in accordance with the prior art shown in FIG. 1 comprises a filter layer 11, and a noise elimination cotton 12. The exhaust gas passing through the filter layer 11 can be filtered and then drained outward. However, most of the exhaust gas is directly drained from the exhaust tail pipe 10 without any pressure back effect whereby the engine has a lower torque at a low rotational speed so that when the car is moved on a slope or is moved at a low rotational speed, the power is not enough due to the low torque of the engine so that the car has to increase its power to climb up the slope fluently, thereby consuming fuel.

SUMMARY OF THE INVENTION

In accordance with one aspect of the present invention, there is provided a turbine exhaust structure for a vehicle, the vehicle comprising an exhaust tail pipe having an inner wall defining a screw hole, and the turbine exhaust structure comprising: a turbine exhaust device secured in the inner wall of the exhaust tail pipe, and a bolt co-operating with a nut for securing the turbine exhaust device in the inner wall of the exhaust tail pipe through the screw hole, wherein, the turbine exhaust device includes a housing secured in the inner wall of the exhaust tail pipe, a wheel disk secured in the housing, a plurality of catch pieces mounted in the wheel disk and defining a plurality of spaces therebetween, an axle base secured in a central portion of the wheel disk, an axle rod rotatably mounted in the axle base of the wheel disk and having a first end provided with a first vane wheel and a second end provided with a second vane wheel, and two bearings mounted between the axle base and the axle rod.

In accordance with another aspect of the present invention, the vehicle comprises a muffler having an inner tube defining a screw hole, and the turbine exhaust structure comprises: a turbine exhaust device secured in the inner tube of the muffler, and a bolt co-operating with a nut for securing the turbine exhaust device in the inner tube of the muffler through the screw hole.

Further benefits and advantages of the present invention will become apparent after a careful reading of the detailed description with appropriate reference to the accompanying drawings.

DETAILED DESCRIPTION OF THE INVENTION

Figure 1:
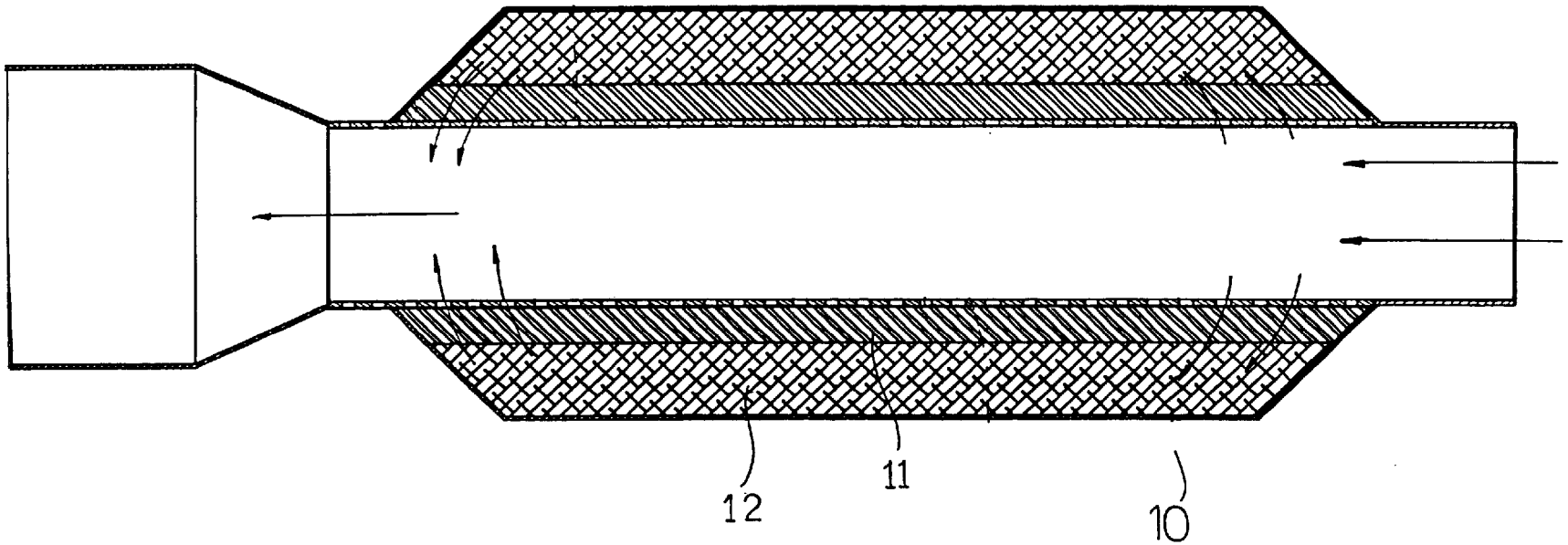
FIG. 1 PRIOR ART
FIG. 1 is a side plan cross-sectional view of a conventional exhaust structure for a vehicle in accordance with the prior art.
Figure 2:
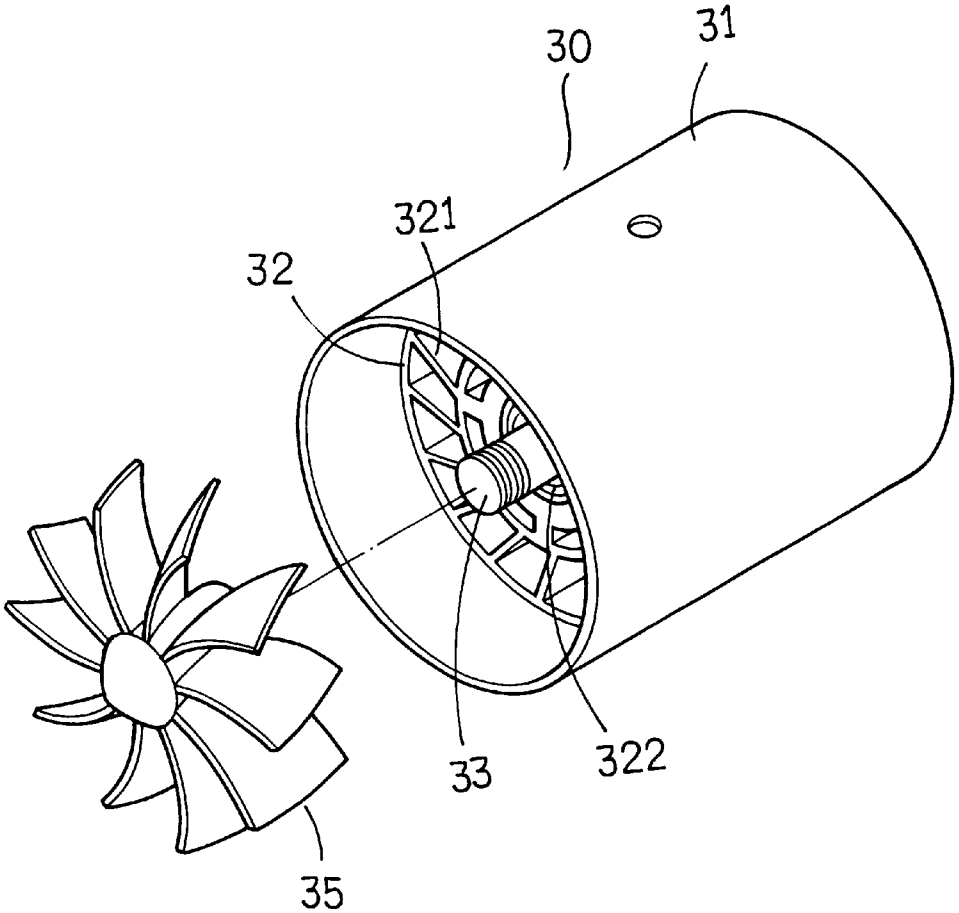
FIG. 2 is an exploded view of a turbine exhaust device of a turbine exhaust structure for a vehicle in accordance with the present invention.
Figure 3:
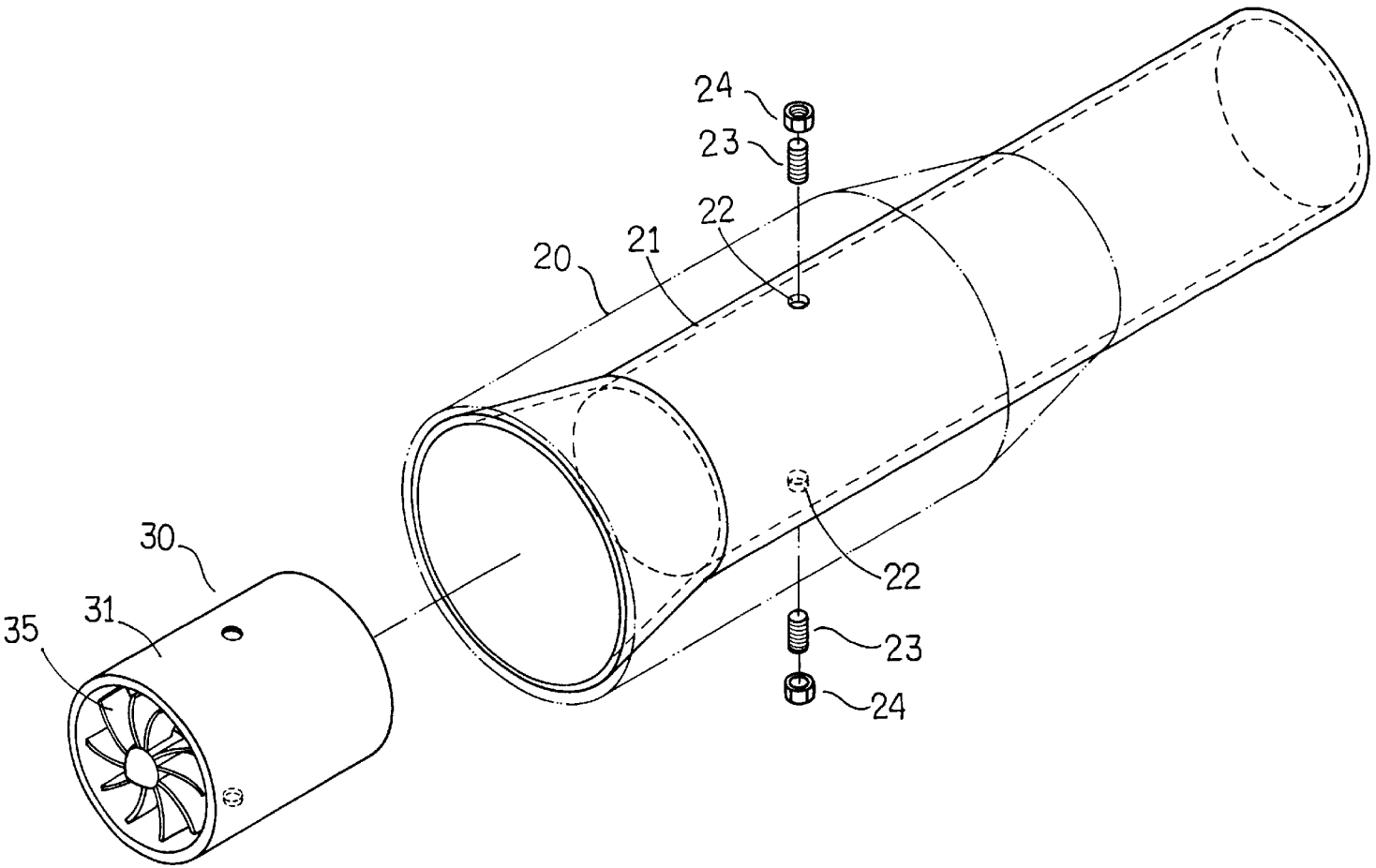
FIG. 3 is an exploded view of the turbine exhaust structure for a vehicle in accordance with the present invention.
Figure 4:
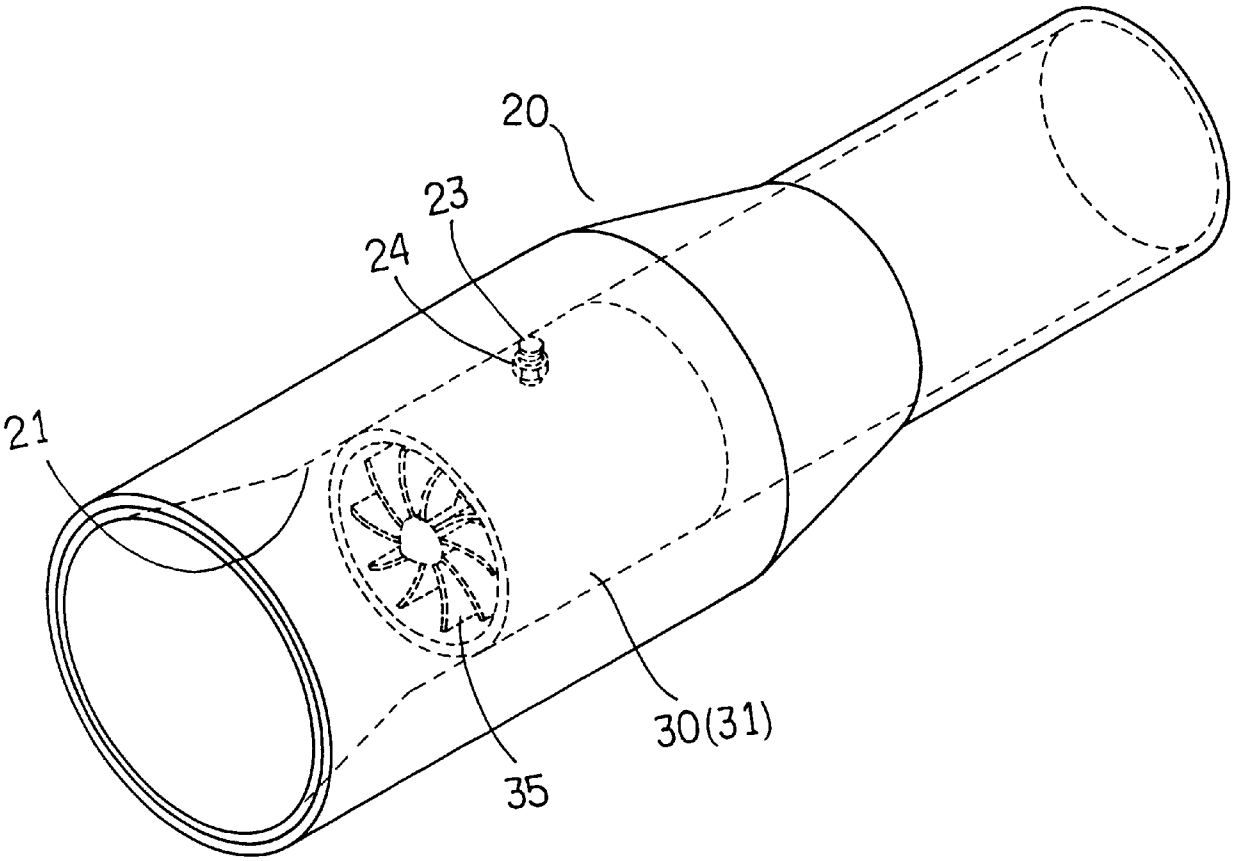
FIG. 4 is a perspective assembly view of the turbine exhaust structure as shown in FIG. 3.
Figure 5:
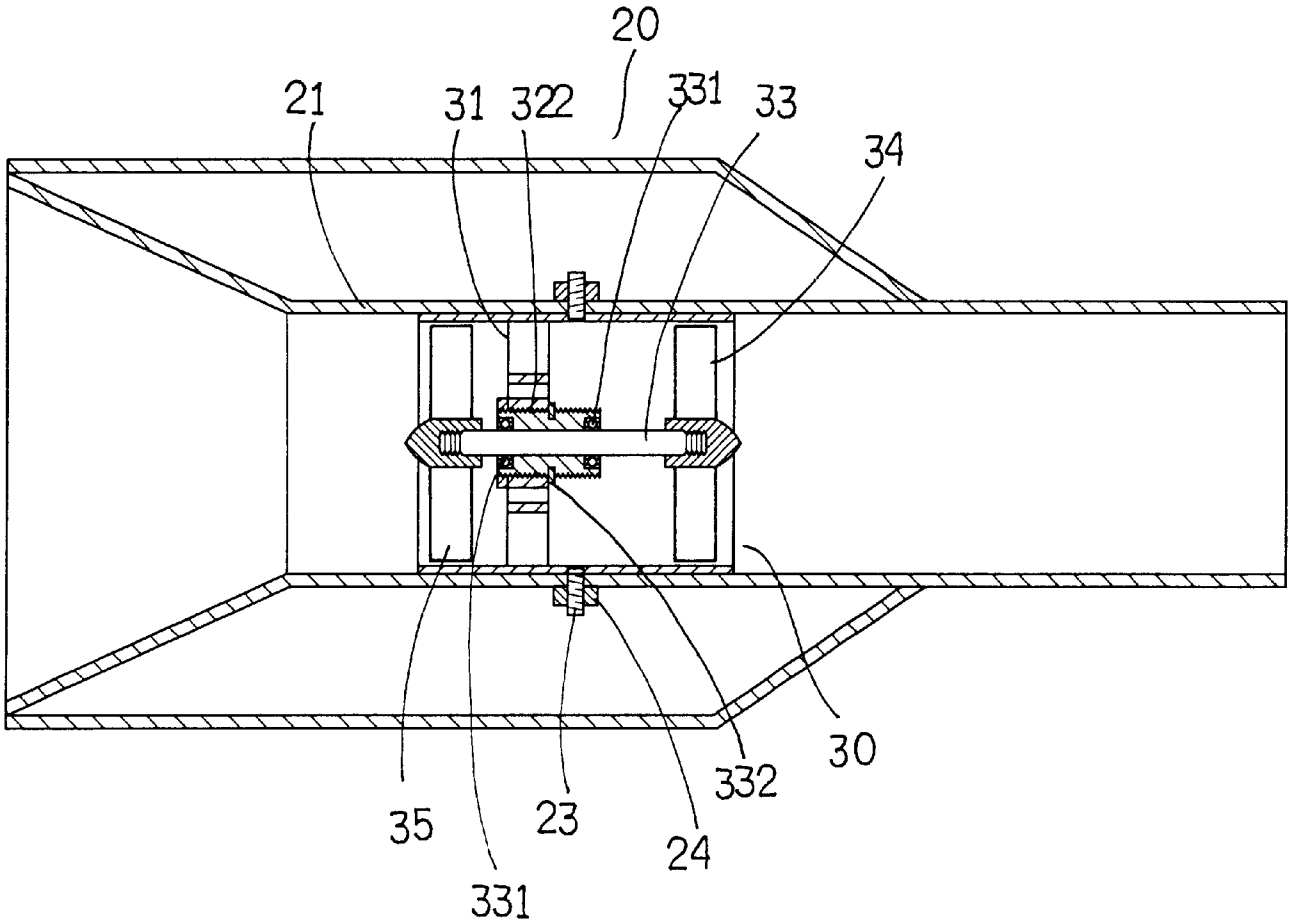
FIG. 5 is a side plan cross-sectional view of the turbine exhaust structure as shown in FIG. 4.

Referring to the drawings and initially to FIGS. 2–5, a turbine exhaust structure in accordance with the present invention is provided for an exhaust tail pipe or a muffler of a vehicle such as a car, a motorcycle or the like. The vehicle comprises an exhaust tail pipe 20 having an inner wall 21 defining a screw hole 22. The turbine exhaust structure comprises a turbine exhaust device 30 secured in the inner wall 21 of the exhaust tail pipe 20, and a bolt 23 co-operating with a nut 24 for securing the turbine exhaust device 30 in the inner wall 21 of the exhaust tail pipe 20 through the screw hole 22.

The turbine exhaust device 30 includes a housing 31 secured in the inner wall 21 of the exhaust tail pipe 20, a wheel disk 32 secured in the housing 31, a plurality of catch pieces 321 mounted in the wheel disk 32 and defining a plurality of spaces (not numbered) therebetween, an axle base 322 secured in a central portion of the wheel disk 32, an axle rod 33 rotatably mounted in the axle base 322 of the wheel disk 32 and having a front end provided with a front vane wheel 34 and a rear end provided with a rear vane wheel 35, a snapping member 332 secured on the wheel base 322 in the wheel disk 32, and two bearings 331 mounted between the axle base 322 and the axle rod 33 so that the axle rod 33 is rotatably mounted on the axle base 322 of the wheel disk 32.

In operation, when the exhaust waste passes through the turbine exhaust device 30, the front vane wheel 34 is pushed to rotate by the gas flow, thereby rotating the axle rod 33 whereby the gas is introduced into the wheel disk 32 through the front vane wheel 34, and is then drained outward through the spaces defined between the catch pieces 321 of the wheel disk 32. When the gas flow passes through the rear vane wheel 35, the gas flow exerts an impact on the rear vane wheel 35, thereby forming a pressure back effect of an interfering current so that the engine of the vehicle has a high torque at a low rotational speed, thereby increasing the power and saving the fuel of the vehicle. In addition, the turbine exhaust device 30 can accelerate the exhaust velocity of the gas by rotation of the vane wheels 34 and 35.

Figure 6:
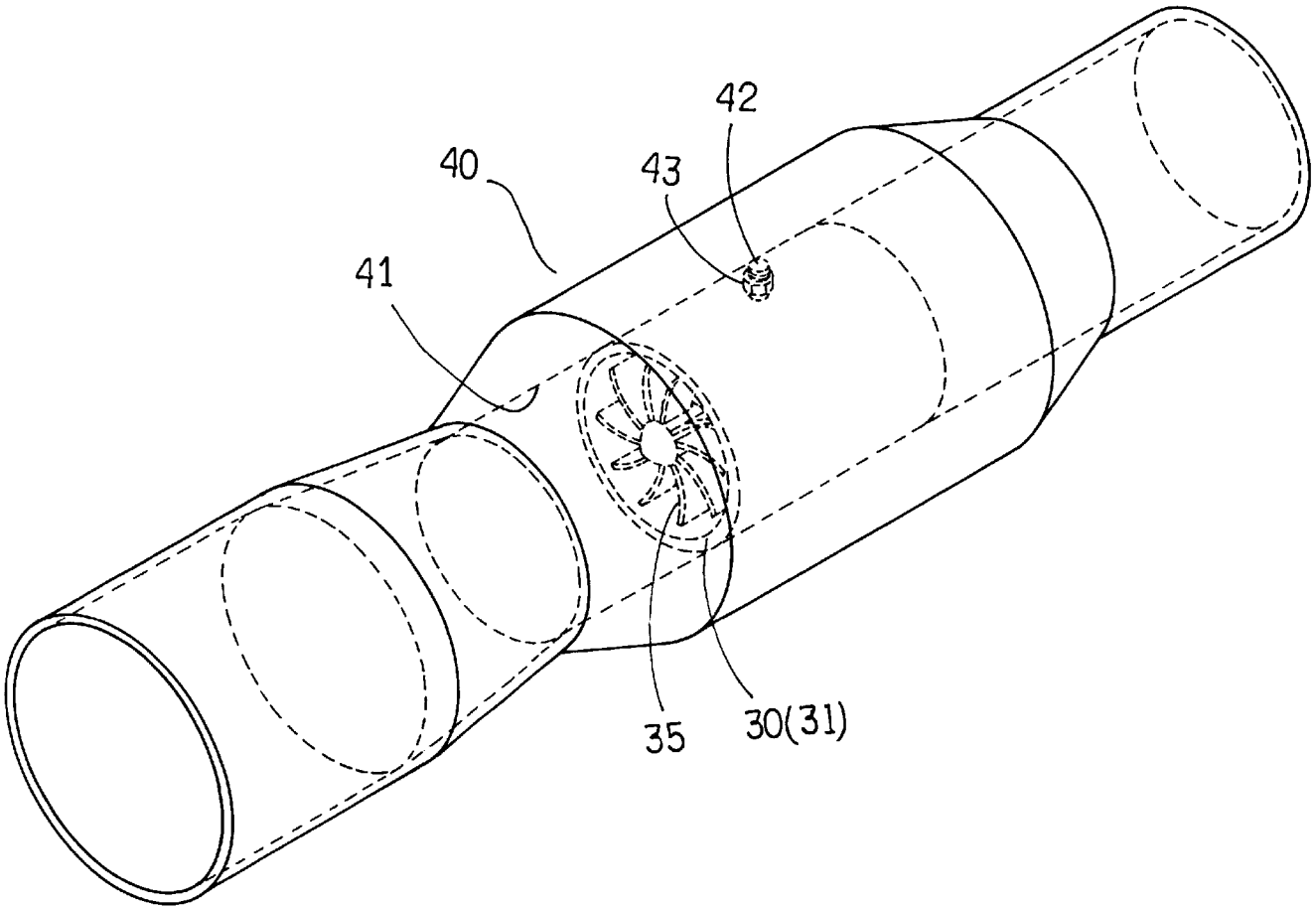
FIG. 6 is a perspective view of a turbine exhaust structure for a vehicle in accordance with another embodiment of the present invention.
Figure 7:
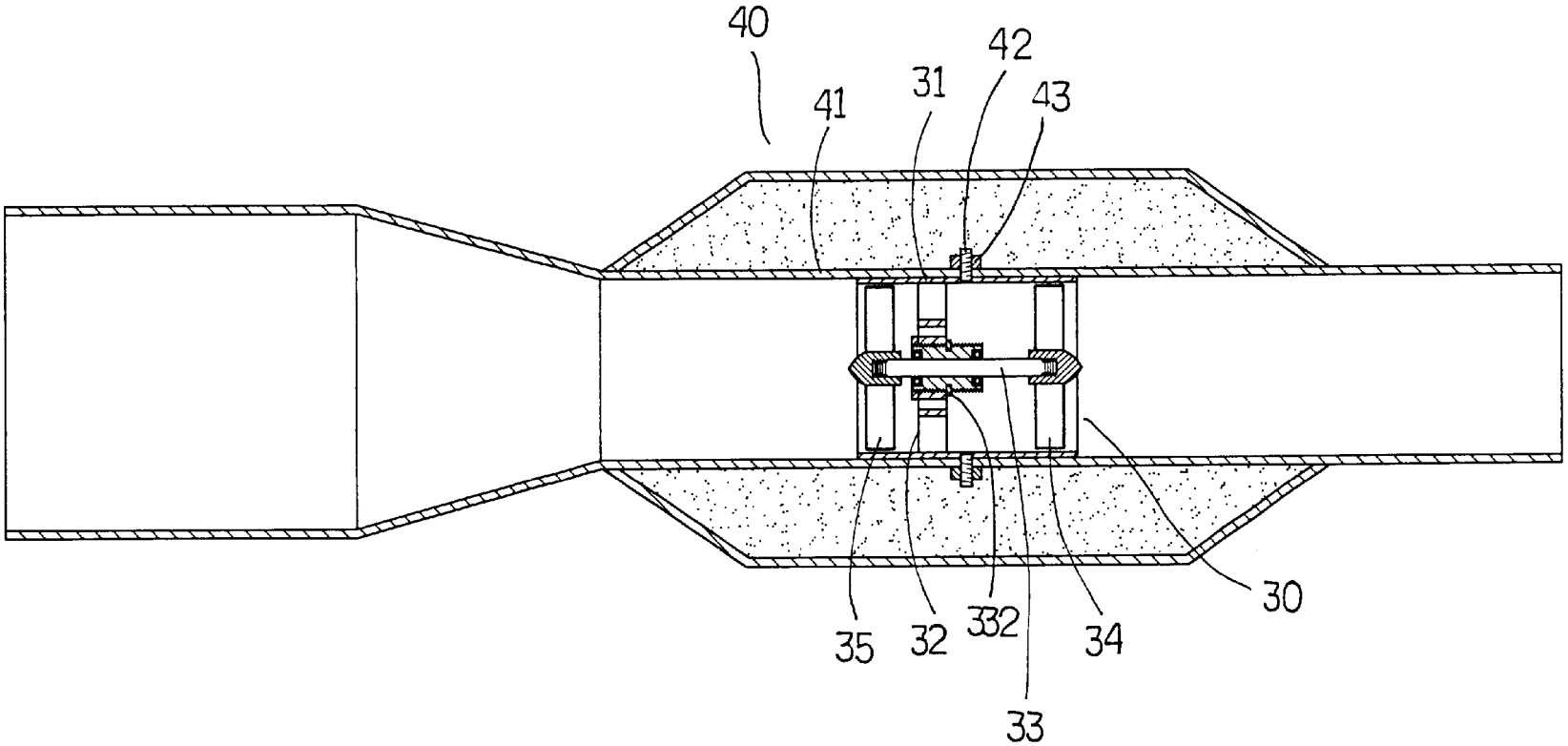
FIG. 7 is a side plan cross-sectional view of the turbine exhaust structure as shown in FIG. 6.

Referring to FIGS. 6 and 7, in accordance with another embodiment of the present invention, the vehicle comprises a muffler 40 having an inner tube 41 defining a screw hole, and the turbine exhaust structure comprises: a turbine exhaust device 30 secured in the inner tube 41 of the muffler 40, and a bolt 42 co-operating with a nut 43 for securing the turbine exhaust device 30 in the inner tube 41 of the muffler 40 through the screw hole.

It should be clear to those skilled in the art that further embodiments may be made without departing from the scope of the present invention.

What is claimed is:

1. A turbine exhaust structure for a vehicle, said vehicle comprising an exhaust tail pipe (20) having an inner wall (21) defining a screw hole (22), and said turbine exhaust structure comprising: a turbine exhaust device (30) secured in said inner wall (21) of said exhaust tail pipe (20), and a bolt (23) co-operating with a nut (24) for securing said turbine exhaust device (30) in said inner wall (21) of said exhaust tail pipe (20) through said screw hole (22), wherein, said turbine exhaust device (30) includes a housing (31) secured in said inner wall (21) of said exhaust tail pipe (20), a wheel disk (32) secured in said housing (31), a plurality of catch pieces (321) mounted in said wheel disk (32) and defining a plurality of spaces therebetween, an axle base (322) secured in a central portion of said wheel disk (32), an axle rod (33) rotatably mounted in said axle base (322) of said wheel disk (32) and having a first end provided with a first vane wheel (34) and a second end provided with a second vane wheel (35), and two bearings (331) mounted between said axle base (322) and said axle rod (33).

2. The turbine exhaust structure for a vehicle in accordance with claim 1, wherein said vehicle comprises a muffler (40) having an inner tube (41) defining a screw hole, and said turbine exhaust structure comprises: a turbine exhaust device (30) secured in said inner tube (41) of said muffler (40), and a bolt (42) co-operating with a nut (43) for securing said turbine exhaust device (30) in said inner tube (41) of said muffler (40) through said screw hole.

* * * * *